US006662761B1

(12) United States Patent
Melchior

(10) Patent No.: US 6,662,761 B1
(45) Date of Patent: Dec. 16, 2003

(54) METHOD FOR REGULATING THE TEMPERATURE OF THE COOLANT IN AN INTERNAL COMBUSTION ENGINE USING AN ELECTRICALLY OPERATED COOLANT PUMP

(75) Inventor: Gerard Melchior, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 195 days.

(21) Appl. No.: 09/807,792

(22) PCT Filed: Jul. 21, 2000

(86) PCT No.: PCT/DE00/02373

§ 371 (c)(1),
(2), (4) Date: Jul. 31, 2001

(87) PCT Pub. No.: WO01/12964

PCT Pub. Date: Feb. 22, 2001

(30) Foreign Application Priority Data

Aug. 18, 1999 (DE) ..... 199 39 138

(51) Int. Cl.[7] ..... F01P 7/16
(52) U.S. Cl. ..... 123/41.44
(58) Field of Search ..... 123/41.15, 41.1, 123/41.44, 41.12

(56) References Cited

U.S. PATENT DOCUMENTS

| | | | | | |
|---|---|---|---|---|---|
| 4,019,489 | A | * | 4/1977 | Cartmill | 123/41.15 |
| 5,036,803 | A | | 8/1991 | Nolting et al. | |
| 5,521,581 | A | * | 5/1996 | Proulx | 123/41.15 |
| 5,724,924 | A | * | 3/1998 | Michels | 123/41.12 |

FOREIGN PATENT DOCUMENTS

| | | | | |
|---|---|---|---|---|
| DE | 37 05 232 | | 9/1988 | |
| DE | 38 10 174 | | 10/1989 | |
| DE | 299 00 023 | | 7/1999 | |
| EP | 0 557 113 | | 8/1993 | |
| EP | 0 731 260 | | 9/1996 | |
| EP | 0 965 737 | | 12/1999 | |
| JP | 6036717 A | * | 2/1985 | 123/41.44 |

* cited by examiner

*Primary Examiner*—Henry C. Yuen
*Assistant Examiner*—Hyder Ali
(74) *Attorney, Agent, or Firm*—Kenyon & Kenyon

(57) ABSTRACT

A method of regulating the temperature of the coolant circuit in an internal combustion engine is described, using an electrically operated coolant pump whose speed regulates or controls the cooling capacity. A great excess of heat can be dissipated and rapid heating of the internal combustion engine can be achieved by using an additional bypass line having corresponding thermostatic valves.

21 Claims, 1 Drawing Sheet

METHOD FOR REGULATING THE TEMPERATURE OF THE COOLANT IN AN INTERNAL COMBUSTION ENGINE USING AN ELECTRICALLY OPERATED COOLANT PUMP

FIELD OF THE INVENTION

The present invention relates to a method of regulating the temperature of a coolant in an internal combustion engine which is connected to a radiator by at least one forward and return line and to a coolant pump.

BACKGROUND INFORMATION

Methods and equipment for cooling the coolant in an internal combustion engine are already known in principle. For example, German Patent No. 37 05 232 describes a method of regulating the temperature of the coolant where a sensor operates a motor actuator as a function of individual engine map characteristics, e.g., rpm and/or engine load, to open or close a bypass valve or the like to achieve a predetermined temperature in the engine coolant circuit. To control the motor actuator, the sensor is heated by a heating device according to the given characteristic data, so it can deliver a suitable signal to the motor actuator. Such a device seems relatively expensive in terms of energy required, because the drive motor for the coolant pump runs constantly, regardless of whether a small amount of waste heat needs to be removed when the internal combustion engine is idling or a large amount when the engine is running.

SUMMARY OF THE INVENTION

The method according to the present invention for regulating the temperature of a coolant in an internal combustion engine, however, has the advantage that the speed of the coolant pump is itself regulated or controlled so that its speed corresponds only to the heat to be dissipated.

It is especially advantageous for the speed control to be determined from the temperature difference between the setpoint and the instantaneous temperature of the internal combustion engine, because significant operating states of the engine are detected in this temperature difference.

By preselecting the setpoint temperature as a function of time, the warmup phase of the engine can be controlled easily in an advantageous manner.

It seems especially advantageous to select the setpoint temperature on the basis of a time table, because an especially easy adjustment to different types of engines and their coolant circuits is possible in this way.

The control signal for the coolant pump can be regulated especially easily and advantageously by using a PID controller.

Another advantage is that in addition to controlling the coolant pump, other valves such as the thermostatic valve, the heating valve or an engine fan can also be controlled to optimize the cooling capacity. This additional influence on the coolant circuit can be used either to make the engine warm up more quickly in the cold start phase or to remove excess heat more rapidly at a high load and when the engine is turned off. This reduces exhaust emissions and prevents overheating of the engine.

It also seems advantageous that a suitable display appears when the engine temperature is exceeded, allowing the driver to react appropriately and thus prevent damage.

It is also advantageous that the parameters are linked in stages in the manner of fuzzy logic to guarantee optimal temperature conditions for the internal combustion engine.

By linking the various parameters such as rpm, engine load, vehicle speed and intake temperature or outside temperature, it is possible to form a control signal for the coolant pump which takes into account all the operating conditions that occur.

GRIEF DESCRIPTION OF THE DRAWINGS

DETAILED DESCRIPTION

Figure 1:
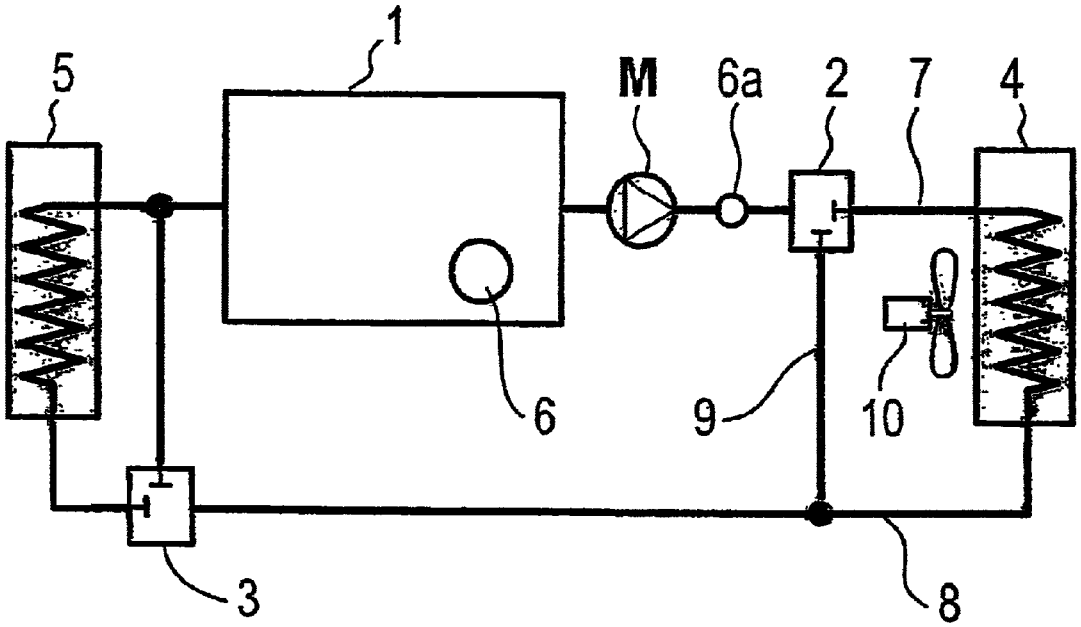
FIG. 1 shows a schematic diagram of a coolant circuit of an internal combustion engine.

In the schematic diagram of the coolant circuit in FIG. 1, internal combustion engine 1 is connected to a radiator 4 via an electrically operated coolant pump M and a thermostatic valve 2 by a forward line 7. At a suitable location, a forward sensor 6*a* for detecting the forward temperature is installed on the forward line 7. In addition, the instantaneous temperature of internal combustion engine 1 is measured with a temperature sensor 6. A return line 8 connects radiator 4 to the coolant circuit of internal combustion engine 1 via a heating valve 3. Heating valve 3 is also connected to heater 5 of the passenger compartment. Likewise, thermostatic valve 2 is connected to return line 8 through another valve and bypass line 9. For the sake of thoroughness, it should also be pointed out that the radiator is thermally connected to one or more engine fans 10, where engine fan 10 may be designed for multiple speeds. According to FIG. 1, valves 2, 3 are designed as 3-way valves.

The functioning of this arrangement is explained in greater detail below on the basis of the block diagram in FIG. 2. Item 11 is a setpoint generator for the engine temperature, which is preselected as a function of time or in the form of a table, for example. The instantaneous engine temperature measured with temperature sensor 6 is processed in a suitable manner in block 12 and sent to summing unit 14. The differential signal between setpoint generator 11 and block 12 forms a correction quantity for the control signal for coolant pump M in block 13. Then the PID controller signal of block 13 is added up in summing unit 15, taking into account other parameters supplied by block 16 for control of the coolant pump. The other parameters include, for example, values for the engine rpm, the instantaneous engine load of the internal combustion engine, vehicle speed, intake temperature or outside temperature, the engine temperature itself and/or the on-board voltage. This is represented symbolically by the parallel arrows at block 16. After linking the signals to the PID controller signal, the control signal for coolant pump M is formed in block 15. Depending on this value, coolant pump M runs at a corresponding speed, thus causing a corresponding change in rate of coolant flow in forward line 7 and/or return line 8. If this control algorithm is not sufficient to adjust the setpoint temperature for the engine, thermostatic valve 2 or multiple-speed engine fan 10 is controlled or a warning display on the dashboard is activated in block 17 after a suitable analysis of the instantaneous engine temperature (block 12) and the control signal for the coolant pump. These elements are represented symbolically by the parallel output arrows of block 17.

Since special functions for control of coolant pump M may be needed for maintenance jobs or in the workshop, a device is provided in block 18 to allow a separate drive for coolant pump M. This block 18 therefore contains suitable devices, e.g., for connecting a workshop tester which drives coolant pump M in filling and venting the cooling system. As an alternative, the internal combustion engine can also be warmed up over this line by using an auxiliary heater (not shown in the figure). Furthermore, operation of coolant pump M to prevent overheating after turning off a hot internal combustion engine 1 can also be controlled over this line.

Figure 2:
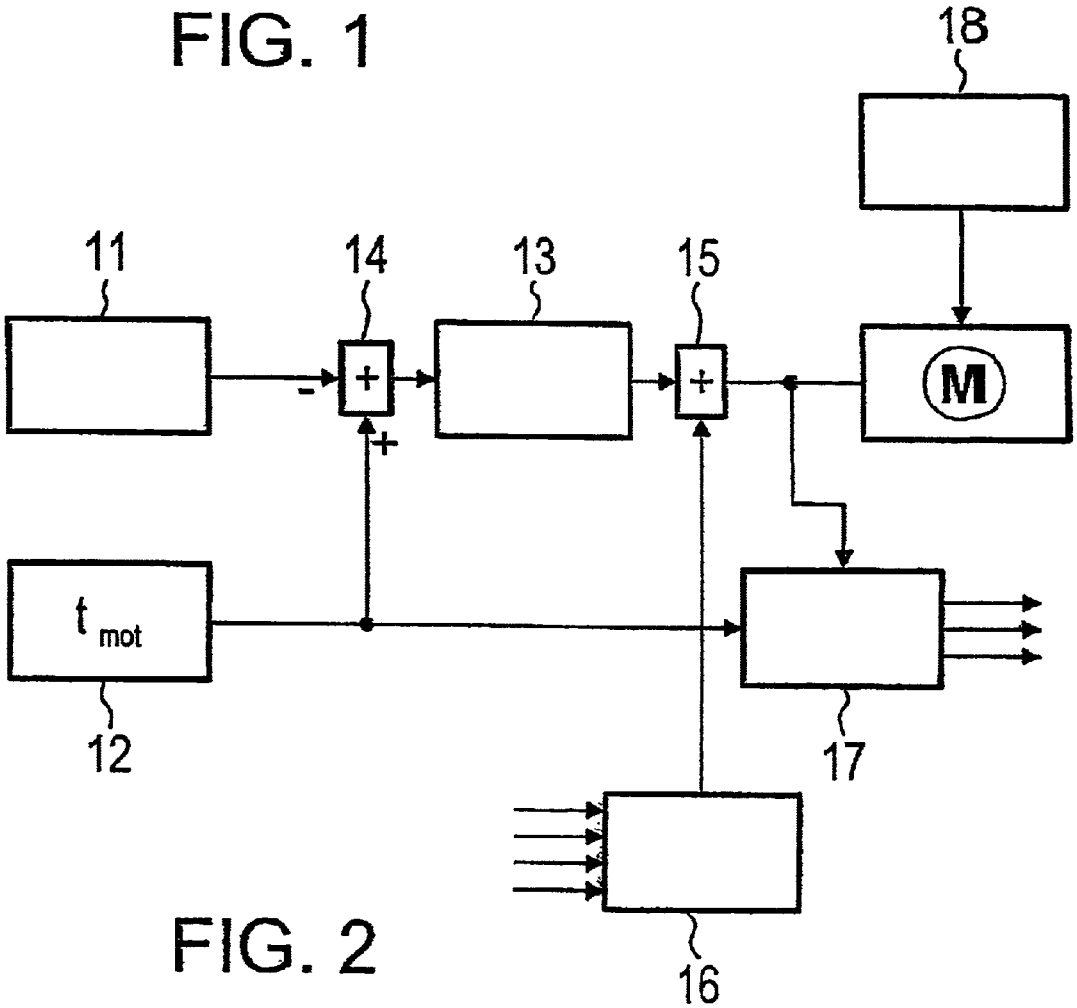
FIG. 2 shows a block diagram of the temperature control.

The blocks shown in FIG. 2 are designed as known components (e.g., PID controllers, temperature sensors, etc.). The simplest linkage is through an appropriate program.

Rules for adjusting the cooling capacity can be taken from Tables 1 and 2. For example, if engine temperature tmot is >85° C. according to Table 1, and if the forward temperature of coolant pump tvkmp is >90%, then thermostatic valve 2 is operated, for example, to coolant over forward line 7 to radiator 4 and then return it over return line 8. If there is a further increase in engine temperature tmot, and if it is >95° C. at the same relative capacity of coolant pump M, then fan speed 1 is activated. Then when the engine temperature rises further to more than 100° C., fan speed 2 is activated. When the temperature of the internal combustion engine increases further to above 110° C., the "overheating" warning is displayed on the dashboard.

Table 2 shows as an example the measures taken to reduce the cooling capacity. If engine temperature tmot is <105° C. and the cooling capacity is <80%, then the "overheating" warning is deactivated. Accordingly, when the engine temperature is <97° C. and the cooling capacity is <80% or <60%, fan speeds 2 and 1, respectively, are turned off. If the temperature drops further, e.g., tmot <83° C. and a cooling capacity <40%, valve 2 is switched so that radiator 4 is turned off and bypass line 9 handles the return flow to internal combustion engine 1. Thermostatic valve 2 also closes at temperatures <75° C., so the engine heats up rapidly according to the given temperature curve. Rapid heating of internal combustion engine 1 has the advantage that the noxious exhaust during the warmup phase can be reduced as rapidly as possible.

Since commercially available electronic components (ICs) are often used for control operations, a further embodiment of the present invention provides for this control to be established according to the principles of fuzzy logic.

TABLE 1

| The following measures can be taken to increase cooling capacity: | | | | |
|---|---|---|---|---|
| tmot > 85° C. | & | tvkmp > 90% | then | thermostatic valve open |
| tmot > 95° C. | & | tvkmp > 90% | then | fan speed 1 on |
| tmot > 100° C. | & | tvkmp > 90% | then | fan speed 2 on |
| tmot > 110° C. | & | tvkmp > 90% | then | "overheating" warning on |

TABLE 2

| The following measures can be taken to reduce cooling capacity: | | | | |
|---|---|---|---|---|
| tmot < 105° C. | & | tvkmp > 80% | then | "overheating" warning Off |
| tmot < 97° C. | & | tvkmp < 80% | then | fan speed 2 off |
| tmot < 97° C. | & | tvkmp < 60% | then | fan speed 1 off |

TABLE 2-continued

| The following measures can be taken to reduce cooling capacity: | | | | |
|---|---|---|---|---|
| tmot < 83° C. | & | tvkmp < 40% | then | thermostatic valve closed |
| tmot < 75° C. | | | then | thermostatic valve closed |

What is claimed is:

1. A method of regulating a temperature of a coolant in an internal combustion engine connected to a radiator by at least one forward line and a return line and having a thermostatic valve, a bypass line arranged between the at least one forward line and the return line, and a coolant pump, comprising the steps of:

electrically driving the coolant pump; and causing a control to select a speed for the coolant pump, as a function of at least one of at least one of engine parameters and ambient parameters, an actual engine temperature, a setpoint engine temperature, and load parameters.

2. The method according to claim 1, wherein:

the at least one of the engine parameters and the ambient parameters corresponds to an engine rpm.

3. The method according to claim 1, further comprising the step of:

determining the speed for the coolant pump at least by a temperature difference between the setpoint engine temperature and an instantaneous temperature of the internal combustion engine.

4. The method according to claim 1, further comprising the step of:

selecting the setpoint engine temperature as a function of time after a start of the internal combustion engine.

5. The method according to claim 3, further comprising the step of:

specifying the setpoint engine temperature based on a time table after a start of the internal combustion engine.

6. The method according to claim 1, wherein:

the control includes a controller with PID characteristics.

7. The method according to claim 1, further comprising the step of:

causing a control signal for the coolant pump to control the thermostatic valve.

8. The method according to claim 1, further comprising the step of:

causing a control signal of the coolant pump to control an engine fan.

9. The method according to claim 1, further comprising the step of:

delivering one of a visual warning signal and an acoustic warning signal when at least one of the actual engine temperature and a forward temperature exceeds a level.

10. The method according to claim 1, further comprising the step of:

selecting at least one additional decision threshold for the actual engine temperature and a coolant capacity of the coolant pump.

11. The method according to claim 10, further comprising the step of:

switching one of the thermostatic valve, an engine fan speed, and a warning indicator in accordance with the at least one additional decision threshold.

12. A method of regulating a temperature of a coolant in an internal combustion engine connected to a radiator by at least one forward line and a return line and having a thermostat valve, a bypass line arranged between the at least one forward line and the return line, and a coolant pump, comprising the steps of:

electrically driving the coolant pump; and causing a control to select a speed for the coolant pump as a function of at least one of engine parameters and ambient parameters.

13. The method according to claim 12, wherein the at least one of the engine parameters and the ambient parameters includes at least one of an engine rpm, an actual engine temperature, a setpoint engine temperature and a load parameter.

14. The method according to claim 12, further comprising the step of determining the speed for the coolant pump at least in accordance with a temperature difference between the setpoint engine temperature and an instantaneous temperature of the internal combustion engine.

15. The method according to claim 12, further comprising the step of selecting the setpoint engine temperature as a function of time after a start of the internal combustion engine.

16. The method according to claim 14, further comprising the step of specifying the setpoint engine temperature based on a time table after a start of the internal combustion engine.

17. The method according to claim 12, wherein the control includes a controller with PID characteristics.

18. The method according to claim 12, further comprising the step of causing a control signal for the coolant pump to control the thermostatic valve.

19. The method according to claim 12, further comprising the step of delivering one of a visual warning signal and an acoustic warning signal when at least one of an actual engine temperature and a forward temperature exceeds a level.

20. The method according to claim 12, further comprising the step of selecting at least one additional decision threshold for the actual engine temperature and a coolant capacity of the coolant pump.

21. The method according to claim 12, further comprising the step of switching one of the thermostatic valve, an engine fan speed, and a warning indicator in accordance with the at least one additional decision threshold.

* * * * *